US009287602B2

(12) United States Patent
Covert et al.

(10) Patent No.: US 9,287,602 B2
(45) Date of Patent: Mar. 15, 2016

(54) FERRITE CIRCULATOR WITH REDUCED-HEIGHT TRANSFORMERS

(71) Applicant: Honeywell International Inc., Morristown, NJ (US)

(72) Inventors: Lance Covert, Montgomery, AL (US); Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 171 days.

(21) Appl. No.: 13/959,977

(22) Filed: Aug. 6, 2013

(65) Prior Publication Data

US 2015/0042411 A1 Feb. 12, 2015

(51) Int. Cl.
*H01P 1/39* (2006.01)

(52) U.S. Cl.
CPC ..... *H01P 1/39* (2013.01)

(58) Field of Classification Search
CPC ..... H01P 1/39; H01P 1/32; H01P 1/38
USPC ..... 333/1.1, 24.2
See application file for complete search history.

(56) References Cited

U.S. PATENT DOCUMENTS

| | | | | |
|---|---|---|---|---|
| 4,697,158 | A | 9/1987 | Hoover et al. | |
| 5,266,909 | A | 11/1993 | Wolfert | |
| 7,280,004 | B2 * | 10/2007 | Kroening | 333/1.1 |
| 7,746,189 | B2 | 6/2010 | Hocine et al. | |
| 8,217,730 | B1 | 7/2012 | Catoiu | |
| 8,803,628 | B1 | 8/2014 | Kroening | |
| 2006/0232353 | A1 | 10/2006 | Kroeing | |
| 2009/0108953 | A1 | 4/2009 | Kroening | |

OTHER PUBLICATIONS

Kroening et al., "Ferrite Circulator With Asymmetric Dielectric Spacers", "U.S. Appl. No. 13/847,011, filed Mar. 19, 2013", pp. 1-22.
Kroening, "Waveguide Circulator With Improved Transition to Other Transmission Line Media", "U.S. Appl. No. 13/848,242, filed Mar. 21, 2013", pp. 1-52.
European Patent Office, "Extended European Search Report for EP Application No. 14168910.9 mailed Jan. 19, 2015", from Foreign Counterpart of U.S. Appl. No. 13/959,977, filed Jan. 19, 2015, pp. 1-5, Published in: EP.

* cited by examiner

*Primary Examiner* — Stephen E Jones
(74) *Attorney, Agent, or Firm* — Fogg & Powers LLC

(57) ABSTRACT

A circulator comprises a waveguide housing having a plurality of hollow waveguide arms that communicate with a central cavity, the waveguide housing having a height defined by a plurality of waveguide sidewalls between a waveguide floor and a waveguide ceiling. A ferrite element is disposed in the central cavity of the waveguide housing, with the ferrite element including a central portion. The ferrite element further includes a plurality of ferrite segments that each extend from the central portion and terminate at a distal end. A plurality of dielectric transformers each having an upper surface protrude into the waveguide arms away from the central cavity along the waveguide floor. The dielectric transformers have a height that is less than the height of the waveguide housing such that the upper surface of the transformers is separated from the waveguide ceiling by a gap.

18 Claims, 17 Drawing Sheets

FERRITE CIRCULATOR WITH REDUCED-HEIGHT TRANSFORMERS

STATEMENT REGARDING FEDERALLY SPONSORED RESEARCH OR DEVELOPMENT

This invention was made with Government support under Government Contract No. H94003-04-D-0005. The Government has certain rights in the invention.

BACKGROUND

Ferrite circulators typically have a metal waveguide housing and dielectric transformers therein that serve as impedance-matching elements to provide an impedance match between air-filled input waveguides and a ferrite loaded junction region. An adhesive is typically used to bond the transformers to the waveguide housing of the circulators. The transformers commonly span the full waveguide height such that they are line-to-line with the waveguide floor and ceiling (or cover) minus the thickness of the adhesive. This structure can create a problem as some circulator assemblies may have transformers that protrude above the height of the waveguide due to transformer tolerances and/or assembly variation, preventing an interference fit.

When a transformer protrudes slightly beyond the waveguide height and a waveguide cover is put in place using fasteners, pneumatic presses, or laser-welding, the transformers can fracture due to interference. In using pneumatic presses to apply tuning covers, the transformer fracturing can occur even when the transformer does not protrude above the waveguide height due to slight bowing in of the cover from the applied pneumatic force.

When a transformer fractures, the unit has to go back to assembly to be re-worked causing delays and increased costs. If the circulator was tuned prior to the transformer fracturing, then the circulator typically has to be re-tuned after the rework.

SUMMARY

A circulator comprises a waveguide housing having a plurality of hollow waveguide arms that communicate with a central cavity, the waveguide housing having a height defined by a plurality of waveguide sidewalls between a waveguide floor and a waveguide ceiling. A ferrite element is disposed in the central cavity of the waveguide housing, with the ferrite element including a central portion. The ferrite element further includes a plurality of ferrite segments that each extend from the central portion and terminate at a distal end. A plurality of dielectric transformers each having an upper surface protrude into the waveguide arms away from the central cavity along the waveguide floor. The dielectric transformers have a height that is less than the height of the waveguide housing such that the upper surface of the transformers is separated from the waveguide ceiling by a gap.

BRIEF DESCRIPTION OF THE DRAWINGS

Understanding that the drawings depict only exemplary embodiments and are not therefore to be considered limiting in scope, the exemplary embodiments will be described with additional specificity and detail through the use of the accompanying drawings, in which.

DETAILED DESCRIPTION

In the following detailed description, embodiments are described in sufficient detail to enable those skilled in the art to practice the invention. It is to be understood that other embodiments may be utilized without departing from the scope of the invention. The following detailed description is, therefore, not to be taken in a limiting sense.

Ferrite circulators with reduced-height transformers are provided, in which the height of the transformers is sufficiently shorter than the height of a waveguide. The transformer height is determined such that any tolerance or assembly variations do not cause the transformer to be line-to-line with or protrude past the height of the waveguide, thereby preventing transformer fracturing and re-work. In addition, transformer fracturing due to deformation of a waveguide cover by a pneumatic press is also prevented, since the transformer is lower than the height of the waveguide.

The transformer dimensions, as well as the transformer material, can be selected to optimize the radio frequency (RF) performance of the circulator. For example, dielectric materials with higher or lower dielectric constants can be employed as the transformer material, depending on the size and shape of the transformer, to improve the impedance of the circulator. The height of the transformers can be up to about 98% of the height of the waveguide, depending on the shape and position of the transformers in the waveguide. The height of the transformers can be at a higher percentage for lower frequency circulators with larger waveguide sizes, and at a lower percentage for higher frequency circulators with smaller waveguide sizes. In an exemplary embodiment, the circulator has a gap or clearance between the top of the waveguide and the top of the transformers of at least about 0.005 inches (about 0.127 mm).

Various embodiments of the ferrite circulator with reduced-height transformers are described hereafter with respect to the drawings.

Figure 1A:
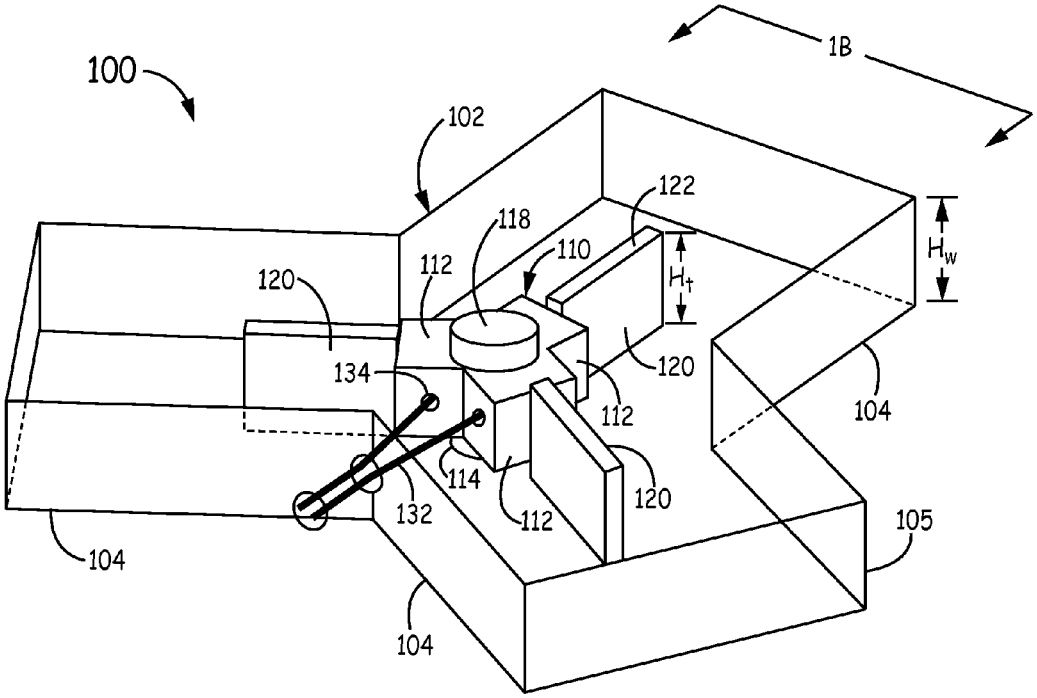
FIG. 1A is a schematic isometric view of a circulator with reduced-height transformers according to one embodiment.
Figure 1B:
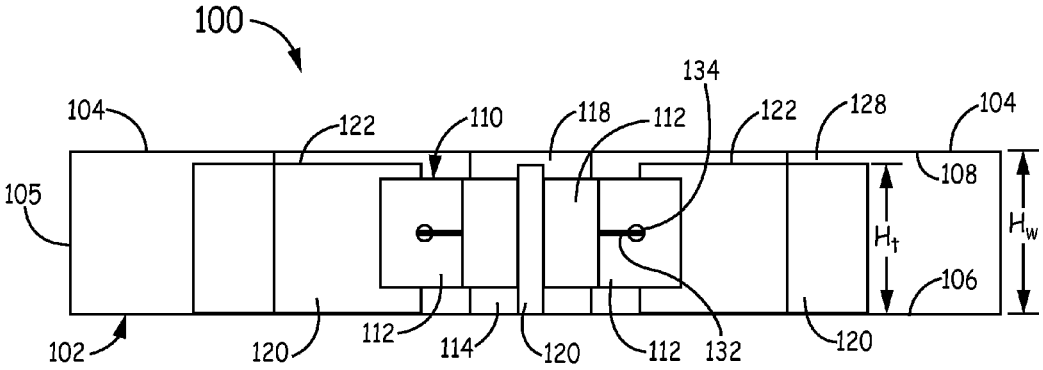
FIG. 1B is a side view of the circulator of FIG. 1A.

FIGS. 1A and 1B illustrate a circulator 100 with reduced-height transformers according to one embodiment. FIG. 1A is an isometric view of circulator 100 with a waveguide cover thereover being transparent to show the components thereunder. The circulator 100 includes an electrically conductive waveguide housing 102 having a plurality of hollow waveguide arms 104 that are air-filled. In the exemplary embodiment shown in FIG. 1A, three waveguide arms 104 extend from a central cavity of the waveguide housing and respectively terminate at a port. The waveguide housing 102 is dimensioned to have a height ($H_w$) that is defined by a plurality of waveguide sidewalls 105 between a waveguide floor 106 and a waveguide ceiling 108 of the cover (FIG. 1B). The waveguide housing 102 can be composed of a metallic material, such as aluminum, a silver-plated metal, a gold-plated metal, or the like.

A ferrite element 110 is disposed in the central cavity of waveguide housing 102. The ferrite element 110 includes a plurality of ferrite segments 112 that each protrude toward a separate waveguide arm 104. As shown in FIG. 1A, ferrite element 110 can have a Y-shaped structure with three ferrite segments 112.

A first dielectric spacer 114 is disposed on a lower surface of ferrite element 110, and a second dielectric spacer 118 is disposed on an upper surface of ferrite element 110. In one embodiment, the first and second dielectric spacers 114 and 118 have substantially the same circular shape. The first and second dielectric spacers 114 and 118 are used to securely position ferrite element 110 in waveguide housing 102 and provide a thermal path out of ferrite element 110 for high power applications. Exemplary materials for the dielectric spacers include boron nitride or beryllium oxide.

A set of dielectric transformers 120 are respectively attached to a central location of each distal end of ferrite segments 112 and protrude into each waveguide arm 104 along waveguide floor 106 in alignment with a central portion of ferrite element 110. The dielectric transformers 120 have a height ($H_t$) that is less than the height ($H_w$) of waveguide housing 102 such that an upper surface 122 of transformers 120 is separated from waveguide ceiling 108 by an air gap 128. The height of the dielectric transformers can be from about 25% to about 98% of the height of the waveguide housing, for example. This configuration for dielectric transformers 120 provides clearance for bowing of a waveguide cover during assembly of circulator 100, while still providing the desired impedance transformation function. In one embodiment, gap 128 provides a clearance between upper surface 122 and waveguide ceiling 108 of at least about 0.005 inches.

The dielectric transformers 120 aid in the transition from ferrite element 110 to the air-filled waveguide arms 104. The dielectric transformers 120 can match the lower impedance of ferrite element 110 to that of the air-filled waveguide arms 104 to reduce signal loss. Suitable materials for the dielectric transformers include boron nitride, aluminum nitride, beryllium oxide, as well as ceramics such as forsterite or cordierite.

A control wire 132 such as a magnetizing winding can be threaded through a channel 134 in ferrite segments 112 in order to make ferrite element 110 switchable. When a current pulse is applied to control wire 132, ferrite element 110 is latched into a certain magnetization. By switching the polarity of the current pulse applied to control wire 132, the signal flow direction in circulator 100 can be switched from one waveguide arm 104 to another waveguide arm 104.

In general, waveguide arms 104 convey microwave energy into and out of circulator 100 through ferrite element 110. For example, one of waveguide arms 104 can function as an input arm and the other waveguide arms 104 can function as output arms, such that a microwave signal propagates into circulator 100 through the input arm and is transmitted out of circulator 100 through one of the output arms.

Figure 2A:
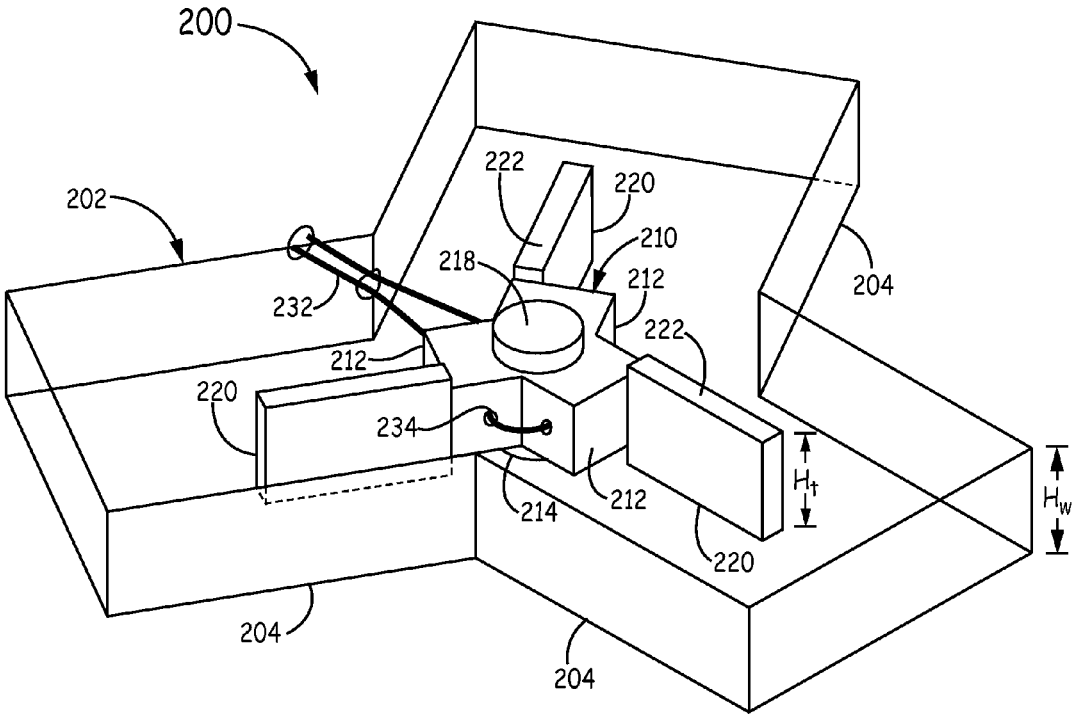
FIG. 2A is a schematic isometric view of a circulator with reduced-height transformers according to another embodiment.
Figure 2B:
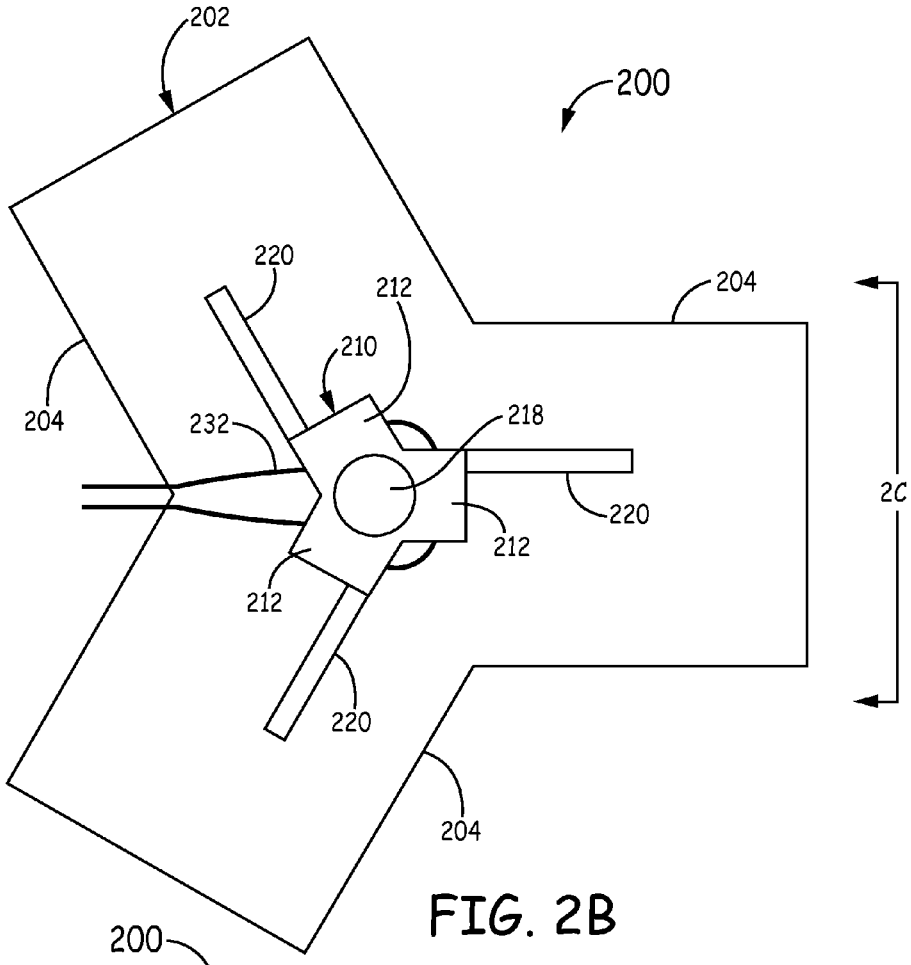
FIG. 2B is a top view of the circulator of FIG. 2A.
Figure 2C:
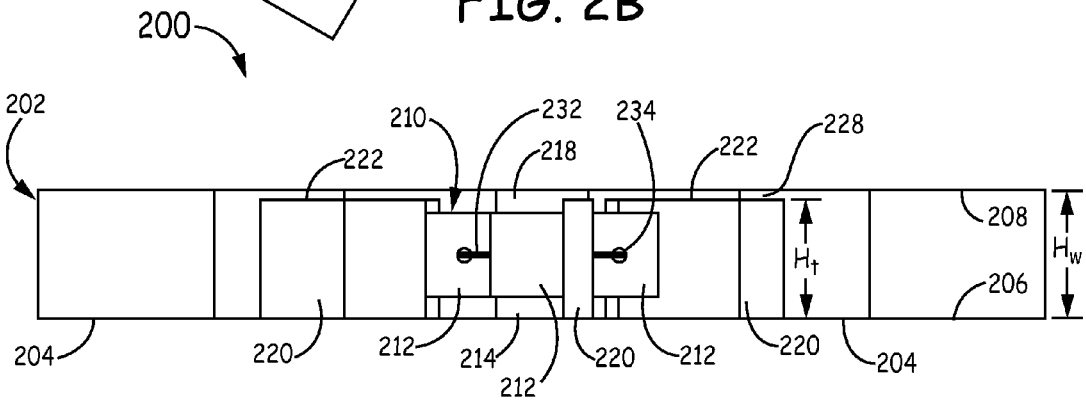
FIG. 2C is a side view of the circulator of FIG. 2A.

FIGS. 2A-2C illustrate a circulator 200 with reduced-height transformers according to another embodiment. The circulator 200 includes similar components as discussed above for circulator 100. For example, circulator 200 includes an electrically conductive waveguide housing 202 having a plurality of hollow waveguide arms 204 that are air-filled, which extend from a central cavity of housing 202. The waveguide housing 202 is dimensioned to have a height ($H_w$) that extends between a waveguide floor 206 and a waveguide ceiling 208. In addition, a ferrite element 210 is disposed in the central cavity of waveguide housing 202. The ferrite element 210 includes a plurality of ferrite segments 212 that each protrude toward a separate waveguide arm 204. A first dielectric spacer 214 is disposed on a lower surface of ferrite element 210, and a second dielectric spacer 218 is disposed on an upper surface of ferrite element 210.

The circulator 200 also includes a set of dielectric transformers 220 having a similar size, shape, and composition as transformers 120 described above. The dielectric transformers 220, however, are respectively attached to each distal end of ferrite segments 212 in an off-center location. As such, dielectric transformers 220 protrude into each waveguide arm 204 in an offset position from a central portion of ferrite element 210, as shown in FIGS. 2A and 2B. The dielectric transformers 220 have a height ($H_t$) that is less than the height ($H_w$) of waveguide housing 202 such that an upper surface 222 of transformers 220 is separated from waveguide ceiling 208 by an air gap 228. The height of dielectric transformers 220 can be from about 25% to about 98% of the height of waveguide housing 202, for example.

With the offset position of transformers 220, air gap 228 can be less than air gap 128 shown in FIG. 1, while still providing enough clearance for the bowing displacement of a waveguide cover for the circulator, as the bowing is at its maximum at the center of the waveguide arms.

A control wire 232 such as a magnetizing winding can be threaded through a channel 234 in ferrite segments 212 in order to make ferrite element 210 switchable.

Figure 3A:
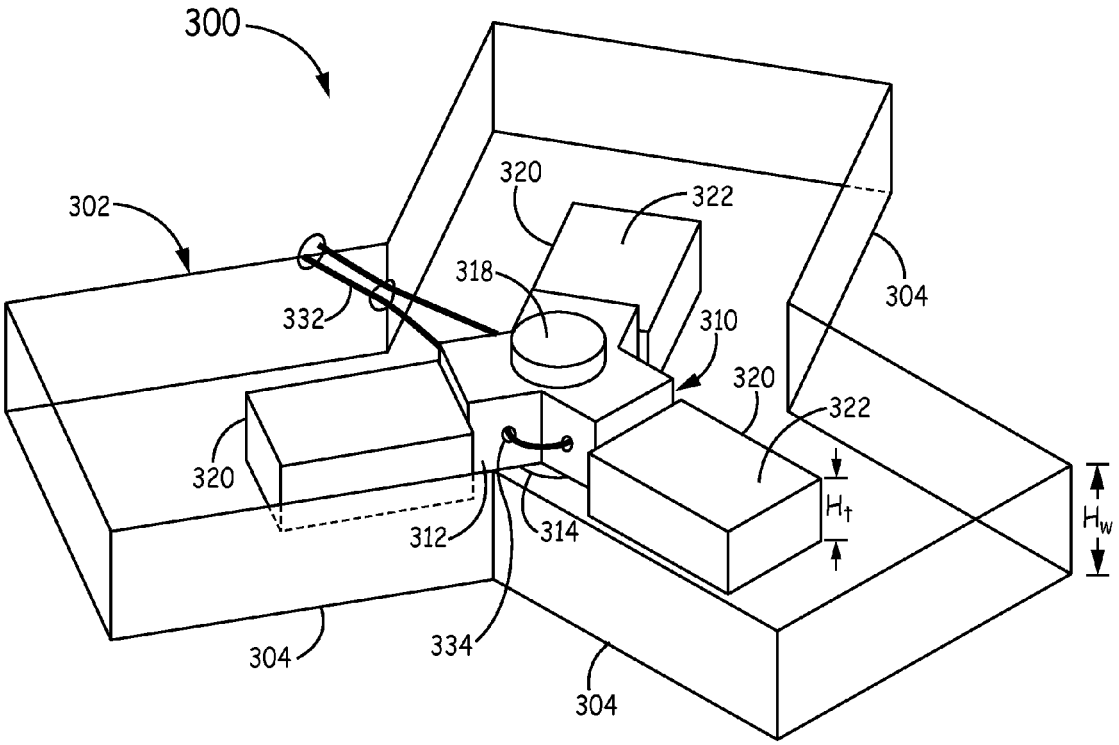
FIG. 3A is a schematic isometric view of a circulator with reduced-height transformers according to a further embodiment.
Figure 3B:
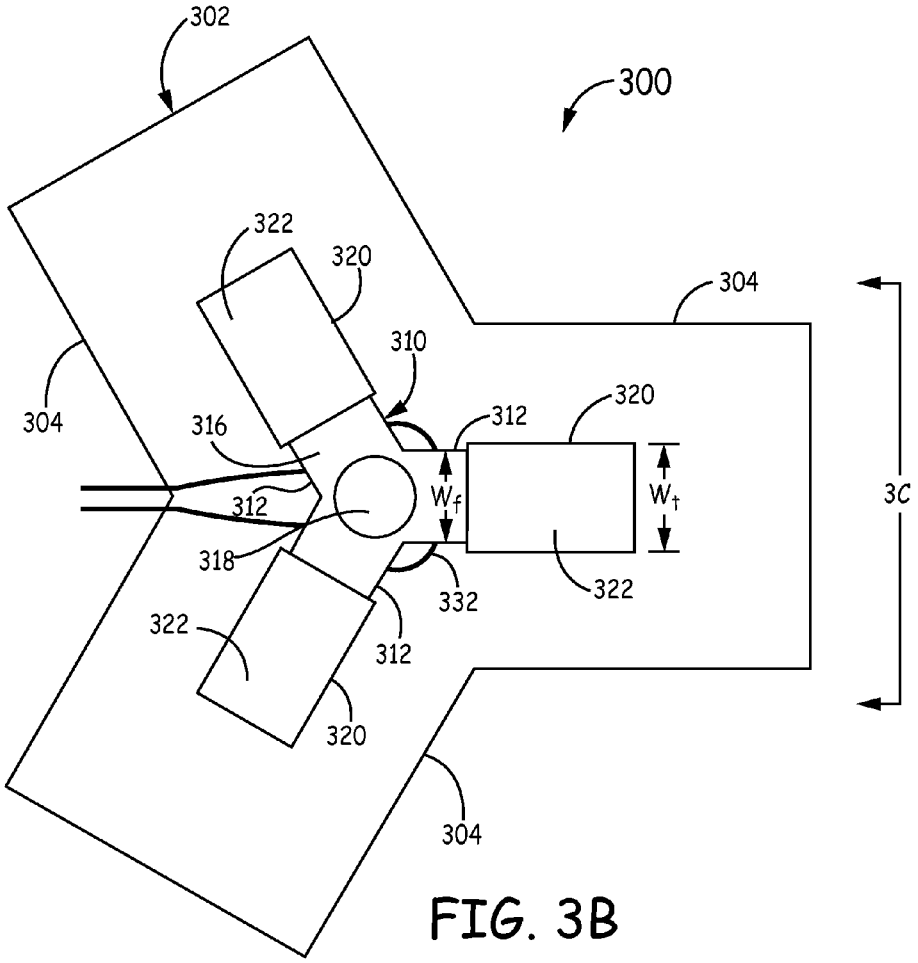
FIG. 3B is a top view of the circulator of FIG. 3A.
Figure 3C:
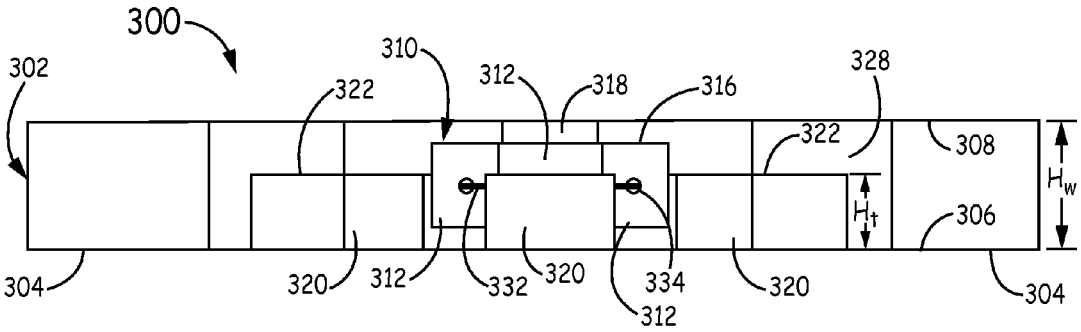
FIG. 3C is a side view of the circulator of FIG. 3A.

FIGS. 3A-3C illustrate a circulator 300 with reduced-height transformers according to a further embodiment. The circulator 300 includes similar components as discussed above for circulator 100. For example, circulator 300 includes a conductive waveguide housing 302 having a plurality of hollow waveguide arms 304 that are air-filled, which extend from a central cavity of housing 302. The waveguide housing 302 is dimensioned to have a height ($H_w$) that extends between a waveguide floor 306 and a waveguide ceiling 308. In addition, a ferrite element 310 is disposed in the central cavity of waveguide housing 302. The ferrite element 310 includes a plurality of ferrite segments 312 that each protrude toward a separate waveguide arm 304. A first dielectric spacer 314 is disposed on a lower surface of ferrite element 310, and a second dielectric spacer 318 is disposed on an upper surface 316 of ferrite element 310.

The circulator 300 also includes a set of dielectric transformers 320 that are respectively attached to each distal end of ferrite segments 312 and protrude into each waveguide arm 304 along waveguide floor 306. As shown in FIGS. 3A and 3C, dielectric transformers 320 have a height ($H_t$) that is less than the height ($H_w$) of waveguide housing 302 such that an upper surface 322 of transformers 320 is separated from waveguide ceiling 308 by an air gap 328. The height of dielectric transformers 320 can be from about 10% to about 80% of the height of waveguide housing 302, for example.

In addition, dielectric transformers 320 have a width ($W_t$) that is greater than a width ($W_f$) of ferrite segments 312 (FIG. 3B). The height of dielectric transformers 320 is reduced such that upper surface 322 of transformers 32 is below upper surface 316 of ferrite element 310.

This configuration for dielectric transformers 320 provides clearance for bowing of a waveguide cover during assembly of circulator 300, while still providing the desired impedance transformation function.

A control wire 332 such as a magnetizing winding can be threaded through a channel 334 in ferrite segments 312 in order to make ferrite element 310 switchable.

Figure 4A:
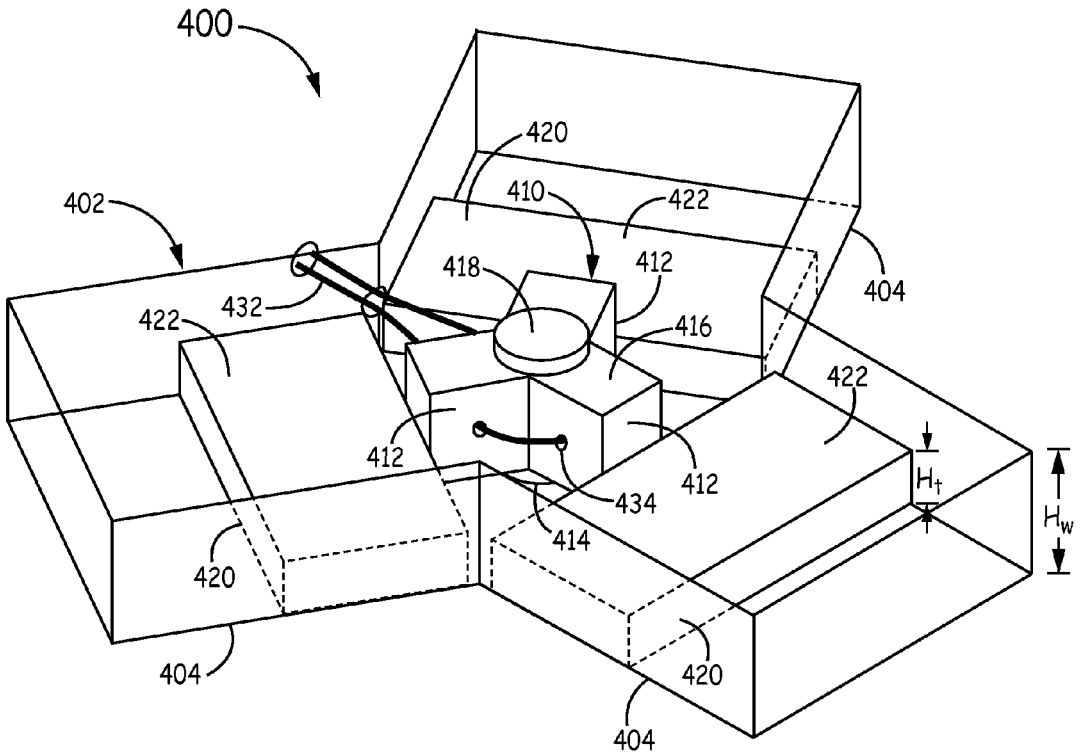
FIG. 4A is a schematic isometric view of a circulator with reduced-height transformers according to another embodiment.
Figure 4B:
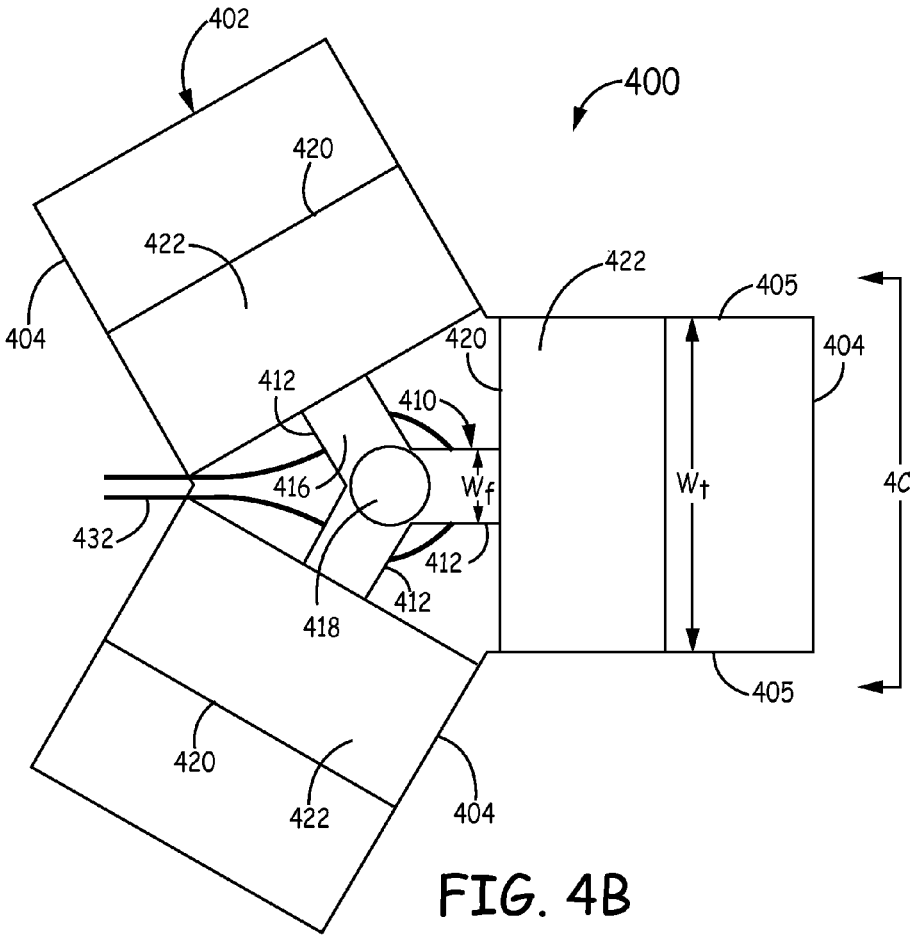
FIG. 4B is a top view of the circulator of FIG. 4A.
Figure 4C:
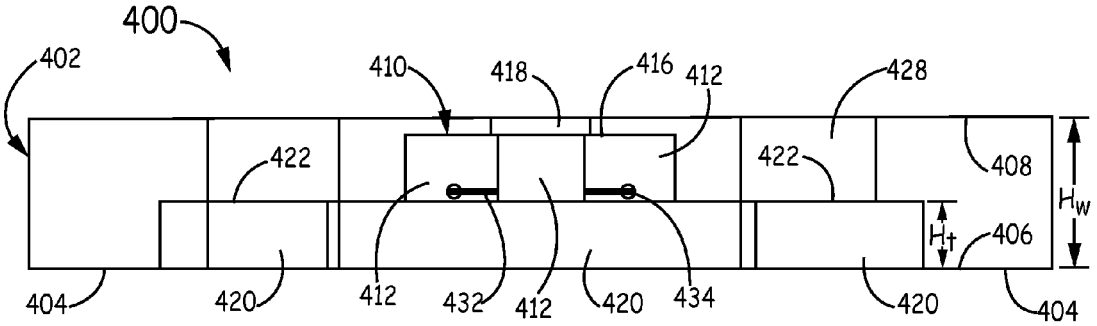
FIG. 4C is a side view of the circulator of FIG. 4A.

FIGS. 4A-4C illustrate a circulator 400 with reduced-height transformers according an alternative embodiment. The circulator 400 includes similar components as discussed above for circulator 300. For example, circulator 400 includes a conductive waveguide housing 402 having a plurality of hollow waveguide arms 404 that are air-filled, which extend from a central cavity of housing 402. The waveguide housing 402 is dimensioned to have a height ($H_w$) that extends between a waveguide floor 406 and a waveguide ceiling 408.

In addition, a ferrite element 410 is disposed in the central cavity of waveguide housing 402. The ferrite element 410 includes a plurality of ferrite segments 412 that each protrude toward a separate waveguide arm 404. A first dielectric spacer 414 is disposed on a lower surface of ferrite element 410, and a second dielectric spacer 418 is disposed on an upper surface 416 of ferrite element 410.

The circulator 400 also includes a set of dielectric transformers 420 that are respectively attached to each distal end of ferrite segments 412 and protrude into each waveguide arm 404 along waveguide floor 406. As shown in FIGS. 4A and 4C, dielectric transformers 420 have a reduced height ($H_t$) that is less than the height ($H_w$) of waveguide housing 402 such that an upper surface 422 of transformers 420 is separated from waveguide ceiling 408 by an air gap 428. The height of dielectric transformers 420 can be from about 5% to about 50% of the height of waveguide housing 402, for example.

In addition, dielectric transformers 420 have an increased width ($W_t$) that is greater than a width ($W_f$) of ferrite segments 412 (FIG. 4B), such that transformers 420 have a width that is substantially the same as a width between opposing sidewalls 405 of waveguide arms 404. The height of dielectric transformers 420 is reduced such that upper surface 422 of transformers 420 is below upper surface 416 of ferrite element 410.

The configuration of dielectric transformers 420 provides clearance for bowing of a waveguide cover during assembly of circulator 100, while still providing the desired impedance transformation function. Moreover, an advantage of using full width transformers is that the transformers can be used to align the three segments of the ferrite element with the three waveguide arms at desired 120 degree angles.

In addition, a control wire 432 such as a magnetizing winding can be threaded through a channel 434 in ferrite segments 412 to make ferrite element 410 switchable.

FIGS. 5A-5D illustrate a circulator 500 with reduced-height transformers according another alternative embodiment. The circulator 500 includes similar components as discussed above for circulator 400. For example, circulator 500 includes a thermally conductive waveguide housing 502 having a plurality of hollow waveguide arms 504 that are air-filled, which extend from a central cavity of housing 502. The waveguide housing 502 is dimensioned to have a height ($H_w$) that extends between a waveguide floor 506 and a waveguide ceiling 508.

In addition, a ferrite element 510 is disposed in the central cavity of waveguide housing 502. The ferrite element 510 includes a plurality of ferrite segments 512 that each protrude toward a separate waveguide arm 504. A first dielectric spacer 514 is disposed on a lower surface 515 of ferrite element 510, and a second dielectric spacer 518 is disposed on an upper surface 516 of ferrite element 510.

Figure 5A:
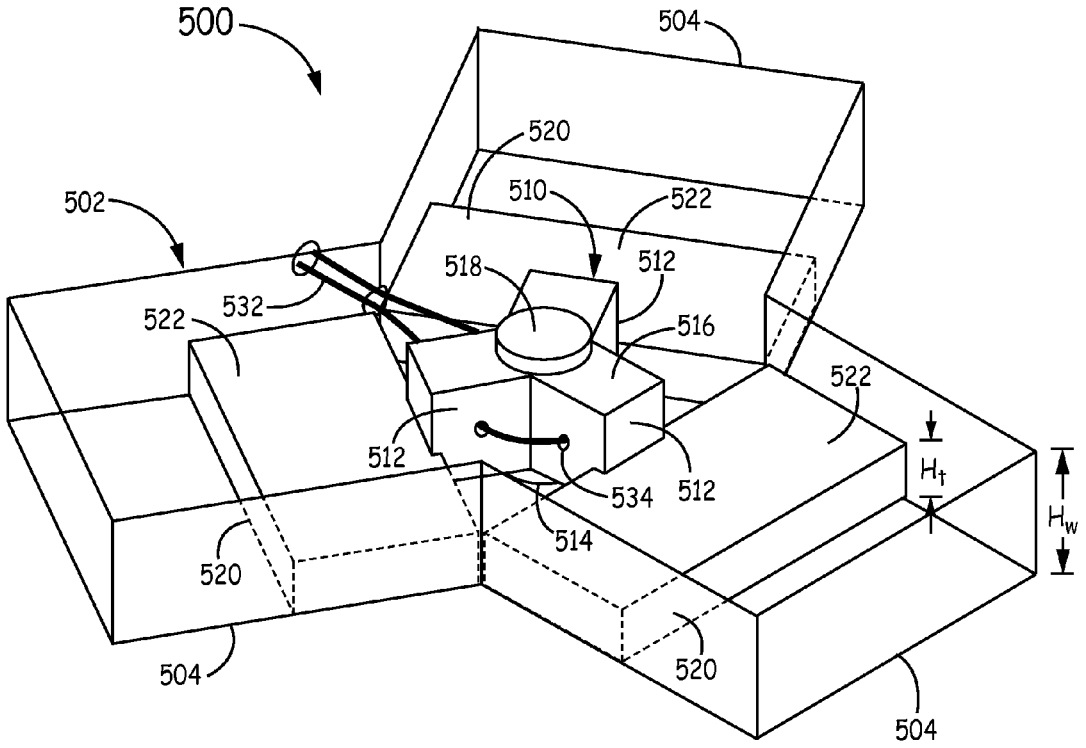
FIG. 5A is a schematic isometric view of a circulator with reduced-height transformers according to an alternative embodiment.
Figure 5B:
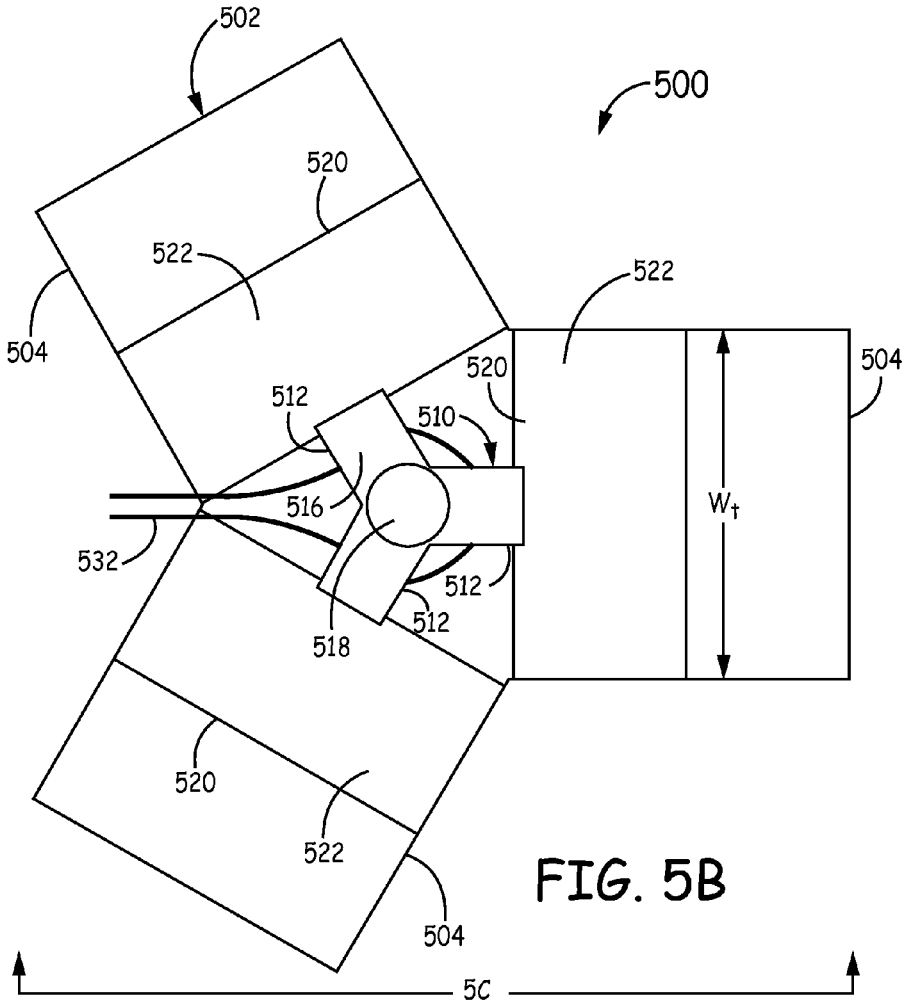
FIG. 5B is a top view of the circulator of FIG. 5A.
Figure 5C:
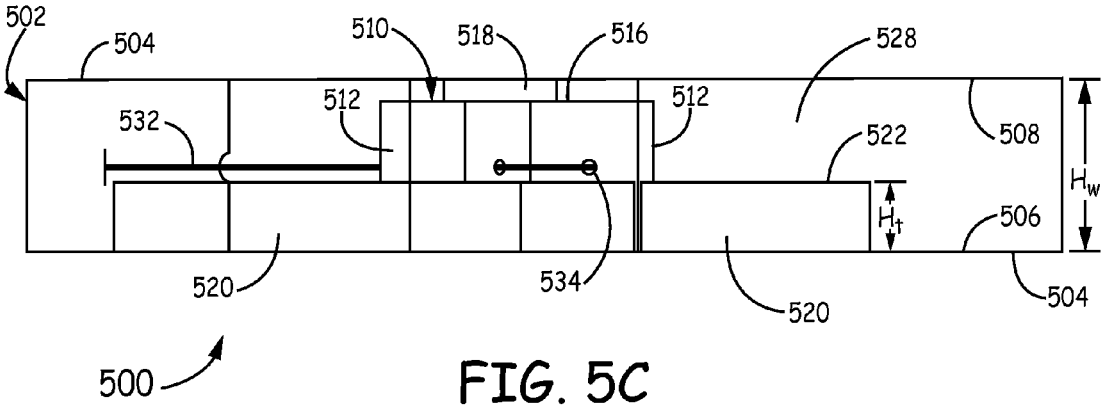
FIG. 5C is a side view of the circulator of FIG. 5A.

The circulator 500 also includes a set of dielectric transformers 520 that are respectively attached to each distal end of ferrite segments 512 and protrude into each waveguide arm 504 along waveguide floor 506. As shown in FIGS. 5A and 5C, dielectric transformers 520 have a reduced height ($H_t$) that is less than the height ($H_w$) of waveguide housing 502 such that an upper surface 522 of transformers 520 is separated from waveguide ceiling 508 by an air gap 528. The height of dielectric transformers 520 can be from about 5% to about 98% of the height of waveguide housing 502, for example. When the height of the transformers is toward the high end of the percentage range, the transformers can be composed of a dielectric material with a reduced dielectric constant, such as boron nitride and beryllium oxide, to improve impedance matching.

Further, dielectric transformers 520 have an increased width ($W_t$) that is greater than a width ($W_f$) of ferrite segments 512 (FIG. 5B), such that transformers 520 are about as wide as the interior of waveguide arm 504. The height of dielectric transformers 520 is reduced such that upper surface 522 of transformers 520 is below upper surface 516 of ferrite element 510.

Figure 5D:
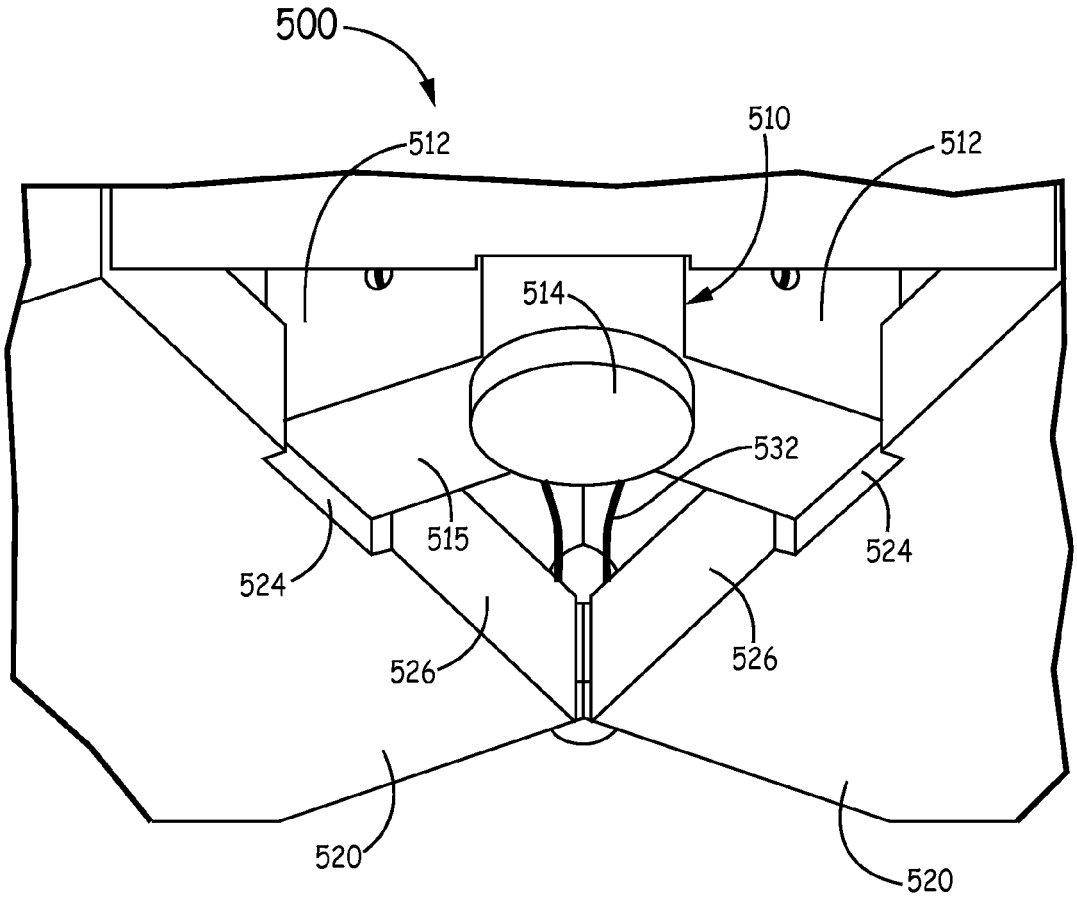
FIG. 5D is an isometric view of a bottom section of the circulator of FIG. 5A.

A recess 524 is located along a proximal edge 526 of each of dielectric transformers 520, as shown in FIG. 5D. The recess 524 is configured to receive a portion of each distal end of ferrite segments 512 such that transformers 520 slightly overlap the distal ends of ferrite segments 512 when mounted thereon.

The configuration for dielectric transformers 520 not only provides clearance for the waveguide cover, but also allows for rotational alignment of ferrite element 510 and also aids in centering ferrite element 510 in waveguide housing 502.

In an alternative embodiment, the dielectric transformers 520 can have a height that is substantially the same as the height of the waveguide housing 502, such that there is no air gap between the transformers and the waveguide ceiling.

In addition, a control wire 532 such as a magnetizing winding can be threaded through a channel 534 in ferrite segments 512 to make ferrite element 510 switchable.

Figure 6A:
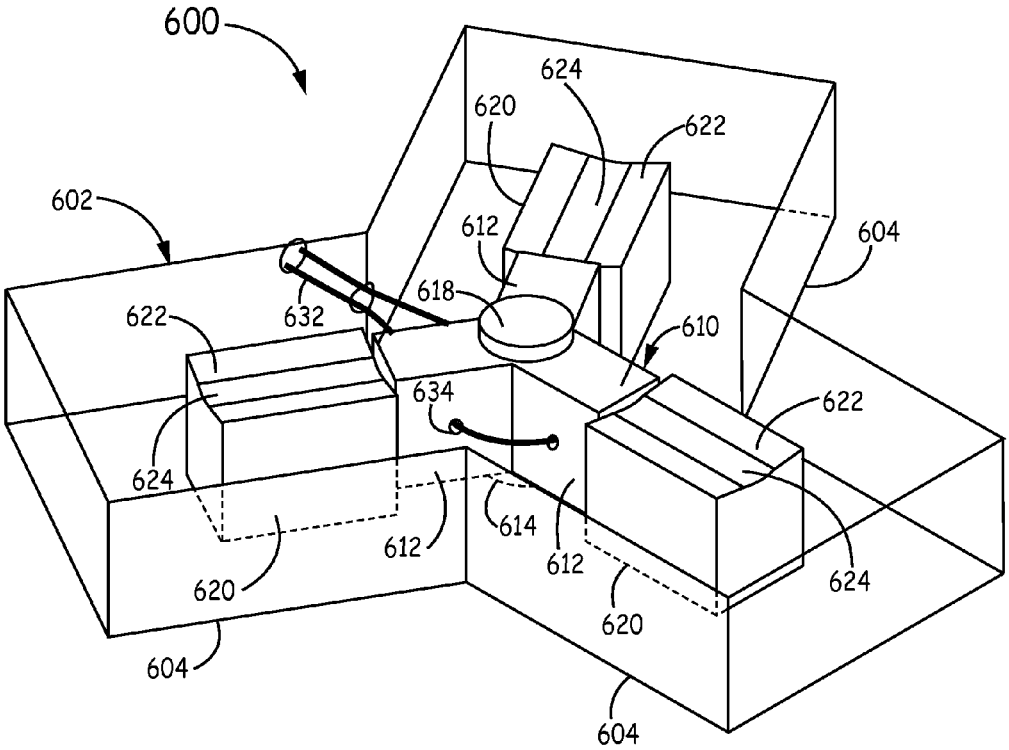
FIG. 6A is a schematic isometric view of a circulator with reduced-height transformers according to another embodiment.
Figure 6B:
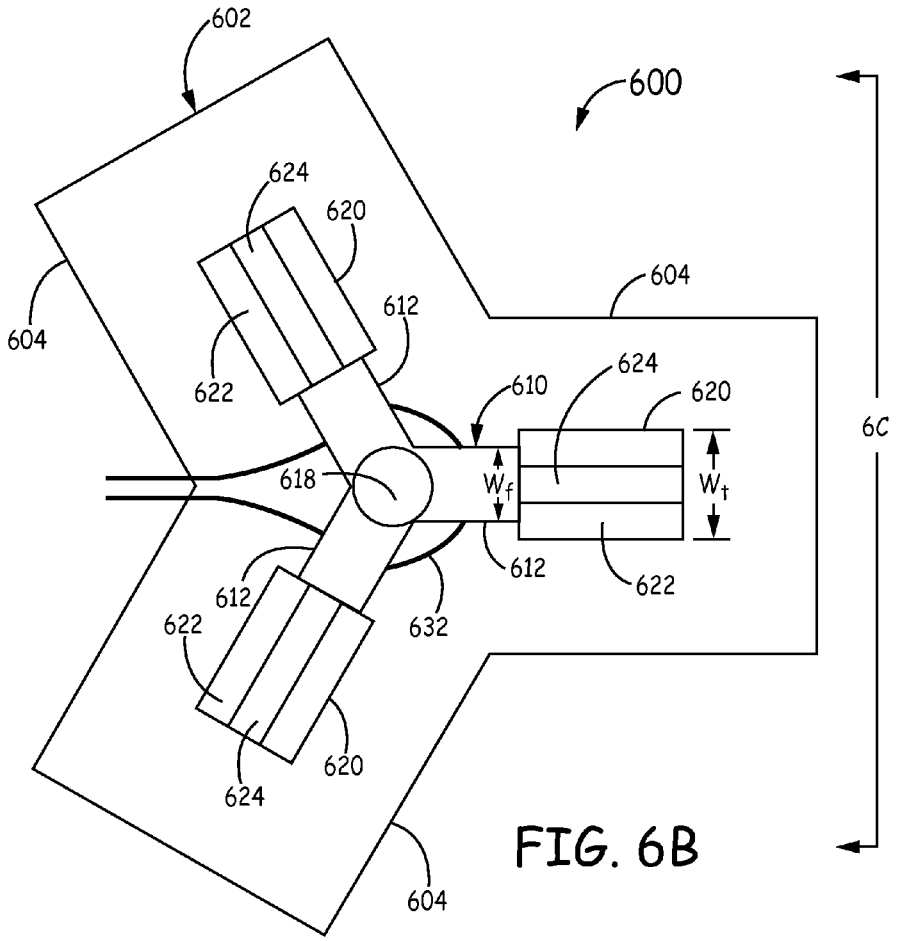
FIG. 6B is a top view of the circulator of FIG. 6A.
Figure 6C:
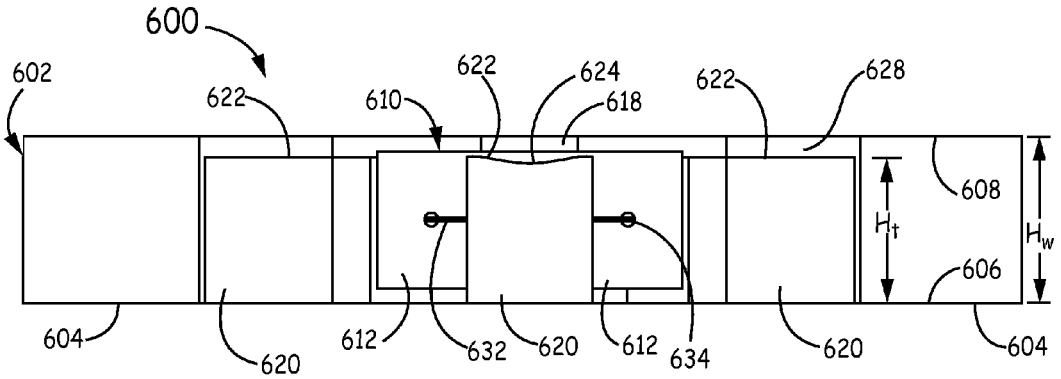
FIG. 6C is a side view of the circulator of FIG. 6A.

FIGS. 6A-6C illustrate a circulator 600 with reduced-height transformers according to a further embodiment, in which the transformers have a greater height reduction in one region and a lesser height reduction in another region. The circulator 600 includes similar components as discussed above for circulator 100. For example, circulator 600 includes a conductive waveguide housing 602 having a plurality of hollow waveguide arms 604 that are air-filled, which extend from a central cavity of housing 602. The waveguide housing 602 is dimensioned to have a height ($H_w$) that extends between a waveguide floor 606 and a waveguide ceiling 608.

A ferrite element 610 is disposed in the central cavity of waveguide housing 602. The ferrite element 610 includes a plurality of ferrite segments 612 that each protrude toward a separate waveguide arm 604. A first dielectric spacer 614 is disposed on a lower surface of ferrite element 610, and a second dielectric spacer 618 is disposed on an upper surface of ferrite element 610.

A plurality of dielectric transformers 620 are respectively attached to each distal end of ferrite segments 612 and protrude into each waveguide arm 604 along waveguide floor 606. The dielectric transformers 620 have a width ($W_t$) that is greater than a width ($W_f$) of ferrite segments 612 (FIG. 6B). In addition, an upper surface 622 of dielectric transformers 620 is tapered inwardly from opposing side edges toward a middle section 624 that is substantially flat, such that the height of transformers 620 is shorter along middle section 624, as shown in FIGS. 6A and 6C. Alternatively, upper surface 622 can be tapered using a stepped configuration or a linear chamfer.

The dielectric transformers 620 have a maximum height ($H_t$) that is still less than the height ($H_w$) of waveguide housing 602 such that upper surface 622 is separated from waveguide ceiling 608 by an air gap 628 (FIG. 6C). The air gap 628 is greatest above middle section 624 of upper surface 622 where the bowing displacement of a waveguide cover for the circulator would be at a maximum. The maximum height of dielectric transformers 620 can be from about 25% to about 98% of the height of waveguide housing 202, for example. This configuration for dielectric transformers 620 provides clearance for the waveguide cover while still providing the desired impedance transformation function.

A control wire 632 such as a magnetizing winding can be threaded through a channel 634 in ferrite segments 612 in order to make ferrite element 610 switchable.

Figure 7A:
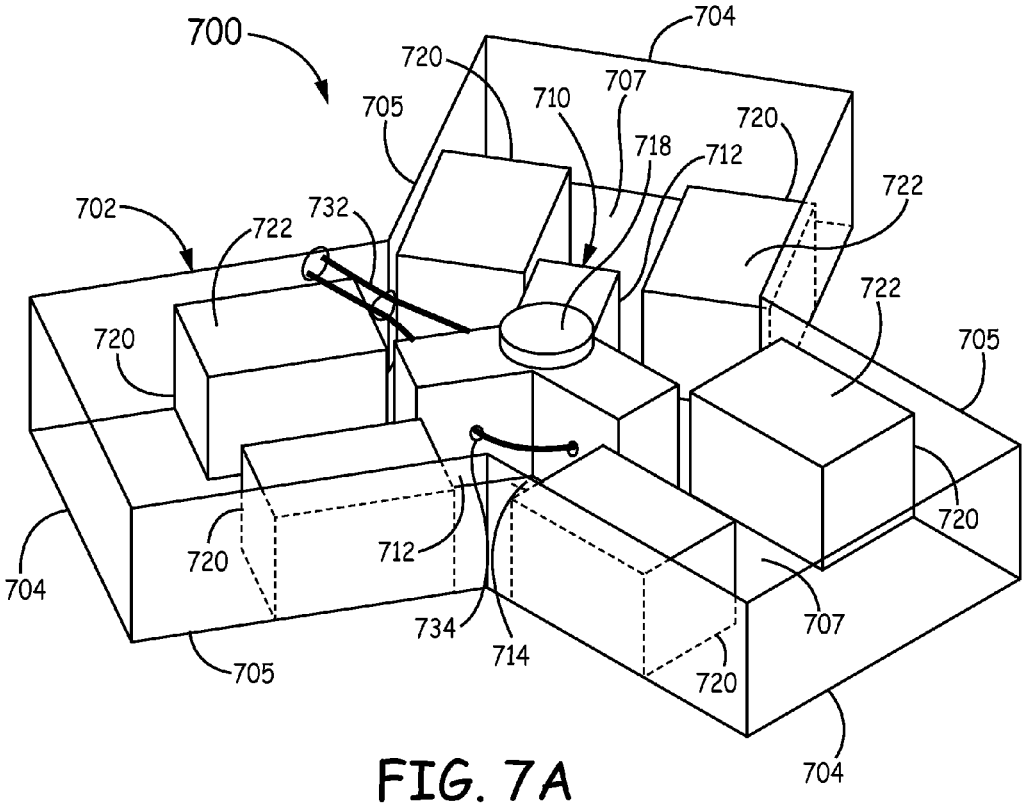
FIG. 7A is a schematic isometric view of a circulator with reduced-height transformers according to an alternative embodiment.
Figure 7B:
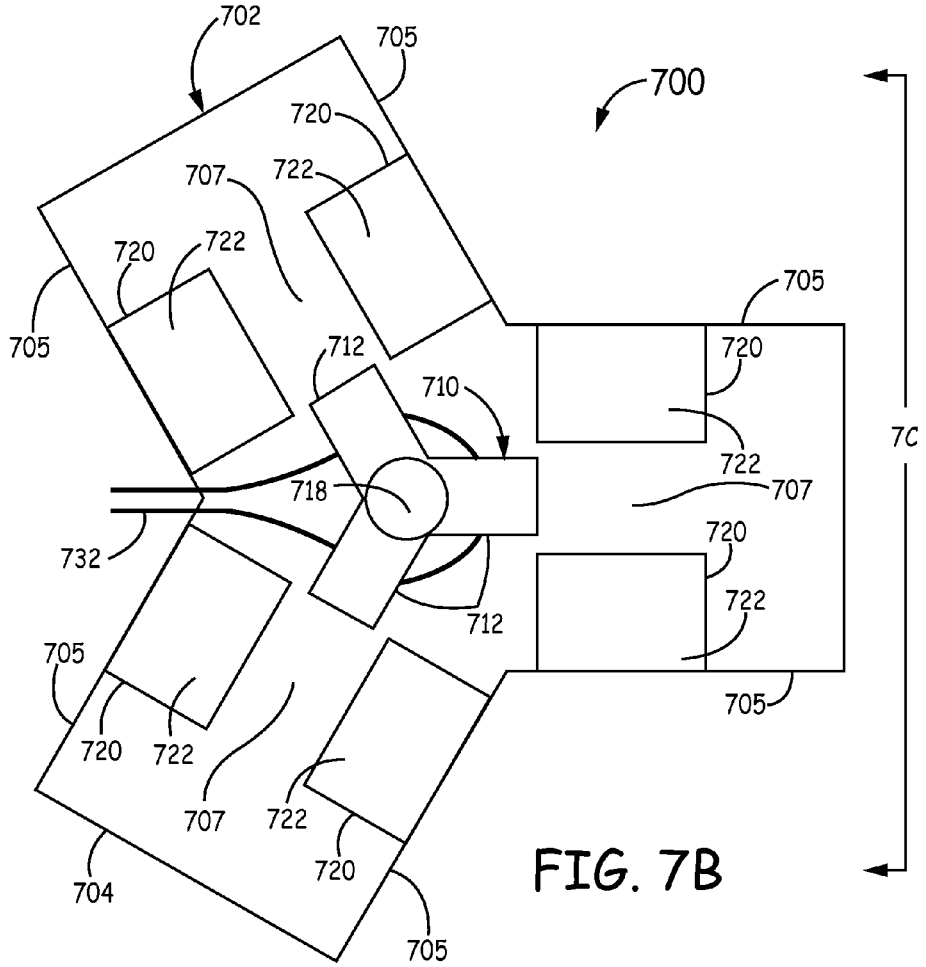
FIG. 7B is a top view of the circulator of FIG. 7A.
Figure 7C:
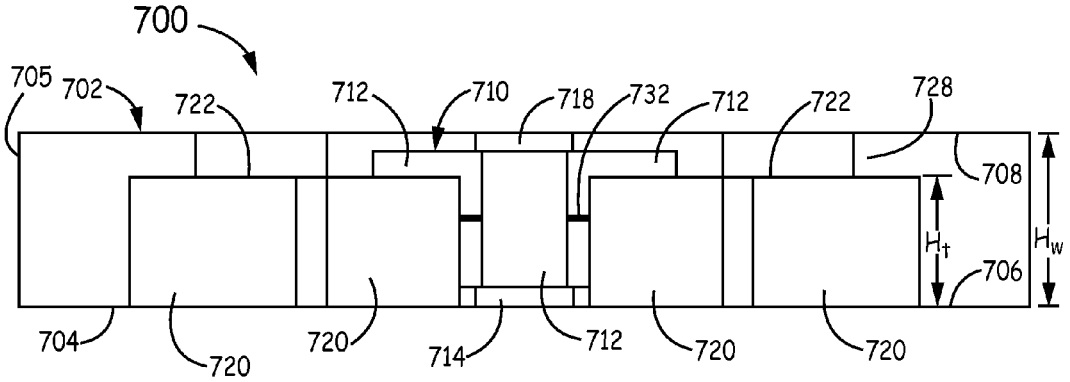
FIG. 7C is a side view of the circulator of FIG. 7A.

FIGS. 7A-7C illustrate a circulator 700 with reduced-height transformers according another embodiment. The circulator 700 includes similar components as discussed above for circulator 100. For example, circulator 700 includes a conductive waveguide housing 702 having a plurality of hollow waveguide arms 704 that are air-filled, which extend from a central cavity of housing 702. The waveguide housing 702 has a height ($H_w$) defined by a plurality of sidewalls 705 that are coupled between a waveguide floor 706 and a waveguide ceiling 708 (FIG. 7C).

In addition, a ferrite element 710 is disposed in the central cavity of waveguide housing 702. The ferrite element 710 includes a plurality of ferrite segments 712 that each protrude toward a separate waveguide arm 704. A first dielectric spacer 714 is disposed on a lower surface of ferrite element 710, and a second dielectric spacer 718 is disposed on an upper surface of ferrite element 710.

The circulator 700 includes a plurality of dielectric transformers 720 that are positioned along sidewalls 705 and along waveguide floor 706 in waveguide housing 702. As shown in FIGS. 7A and 7B, a pair of opposing transformers 720 is positioned in each waveguide arm 704 and separated from an adjacent ferrite segment 712 such that a central section 707 of waveguide arms 704 is open between each pair of transformers 720. The dielectric transformers 720 have a reduced height ($H_t$) that is less than the height ($H_w$) of waveguide housing 702 such that an upper surface 722 of transformers 720 is separated from waveguide ceiling 708 by an air gap 728. The height of dielectric transformers 720 can be from about 10% to about 80% of the height of waveguide housing 702, for example. The open central section 707 of waveguide arms 704 is located where the bowing displacement of a waveguide cover for the circulator would be at a maximum, thereby avoiding interference with the waveguide cover.

In addition, a control wire 732 such as a magnetizing winding can be threaded through a channel 734 in ferrite segments 712 to make ferrite element 710 switchable.

FIGS. 8A-8D illustrate a circulator 800 with reduced-height transformers according another alternative embodiment. The circulator 800 includes similar components as discussed above for circulator 700. For example, circulator 800 includes a conductive waveguide housing 802 having a plurality of hollow waveguide arms 804 that are air-filled, which extend from a central cavity of housing 802. The waveguide housing 802 has a height ($H_w$) defined by a plurality of sidewalls 805 that are coupled between a waveguide floor 806 and a waveguide ceiling 808 (FIG. 7C).

In addition, a ferrite element 810 is disposed in the central cavity of waveguide housing 802. The ferrite element 810 includes a plurality of ferrite segments 812 that each protrude toward a separate waveguide arm 804. A first dielectric spacer 814 is disposed on a lower surface 815 of ferrite element 810, and a second dielectric spacer 818 is disposed on an upper surface 816 of ferrite element 810.

Figure 8A:
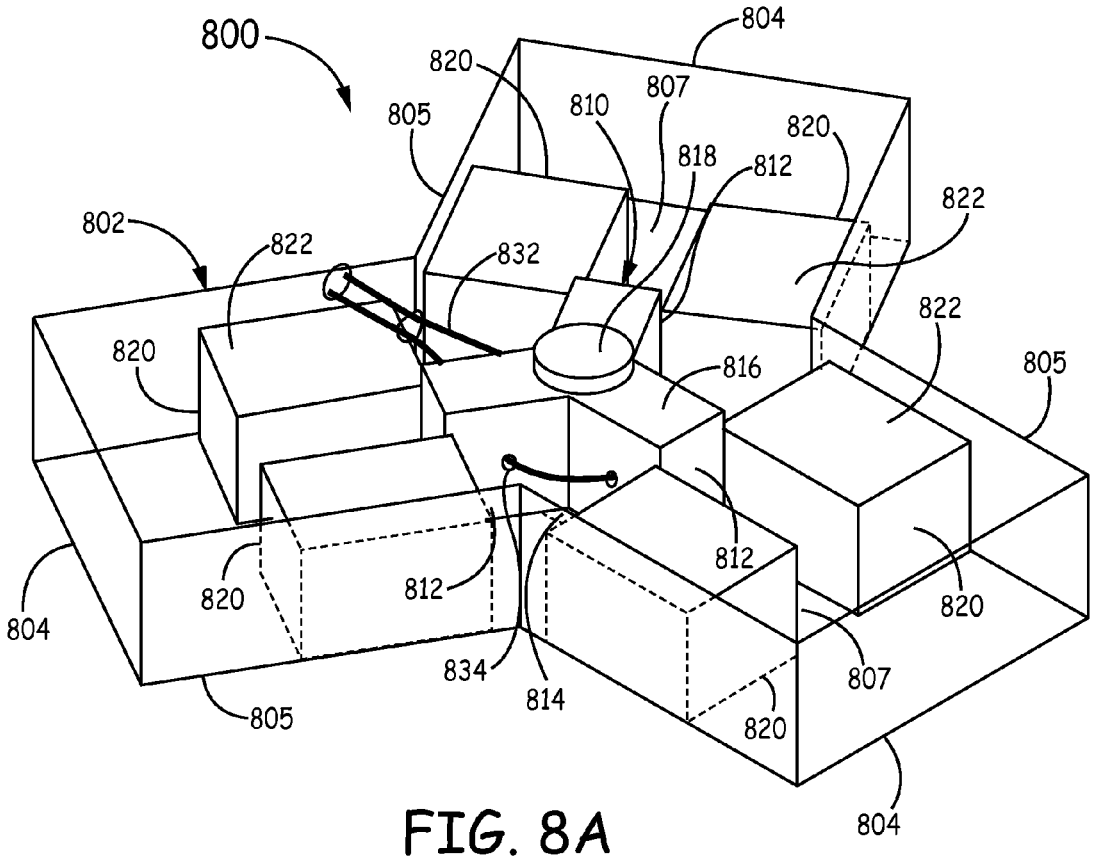
FIG. 8A is a schematic isometric view of a circulator with reduced-height transformers according to another alternative embodiment.
Figure 8B:
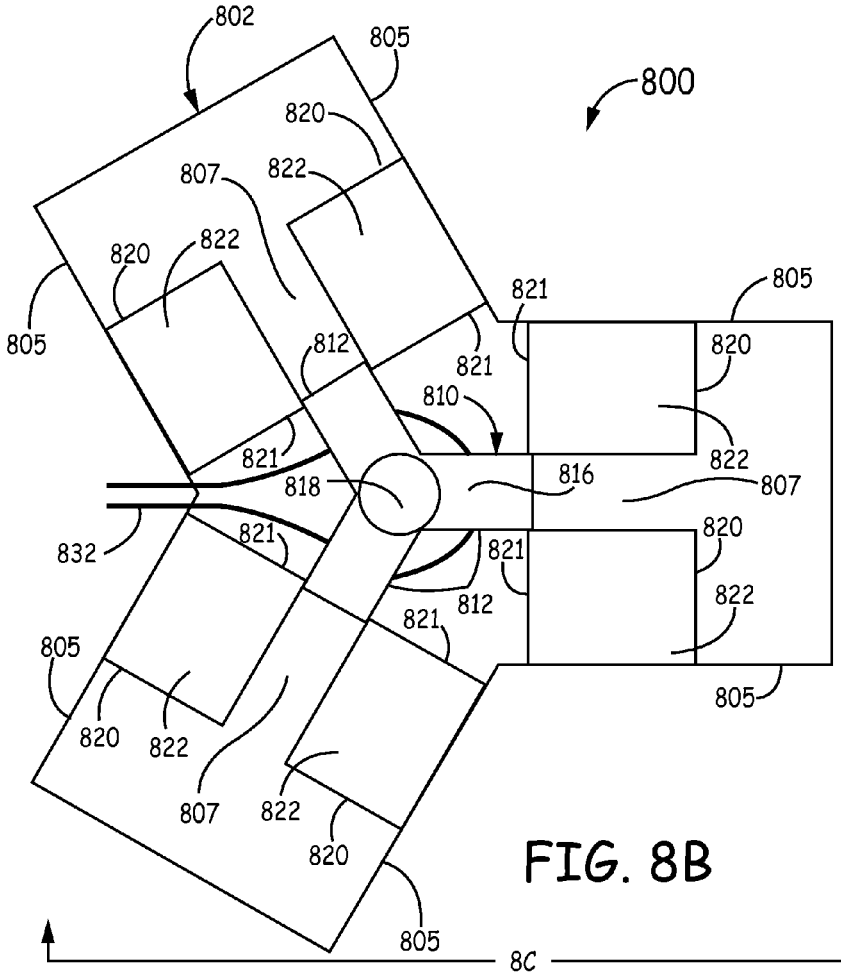
FIG. 8B is a top view of the circulator of FIG. 8A.
Figure 8C:
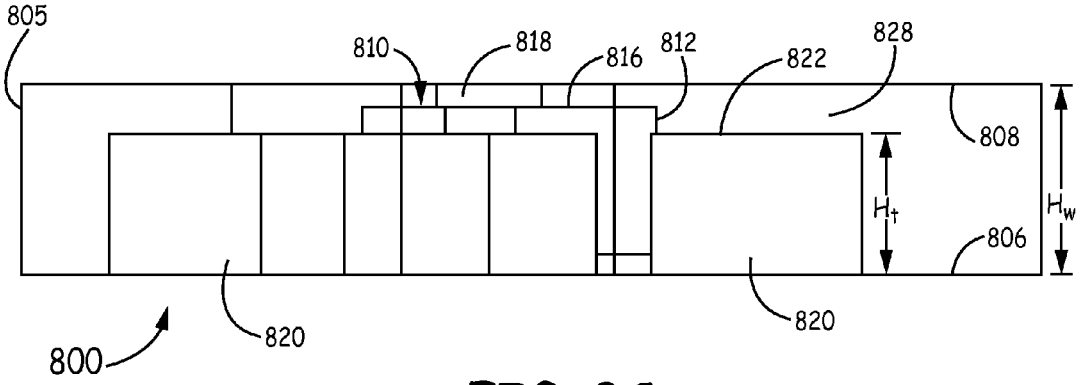
FIG. 8C is a side view of the circulator of FIG. 8A.
Figure 8D:
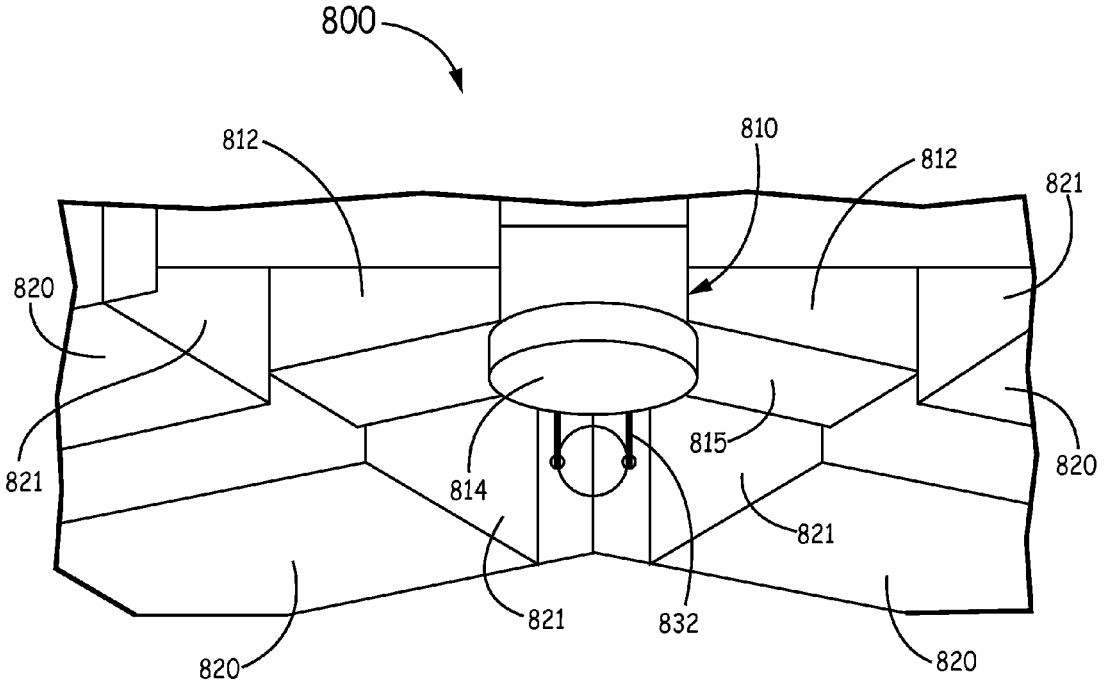
FIG. 8D is an isometric view of a bottom section of the circulator of FIG. 8A.

The circulator 800 includes a plurality of dielectric transformers 820 that are positioned adjacent to sidewalls 805 in waveguide housing 802 along waveguide floor 806. As shown in FIGS. 8A and 8B, a pair of opposing transformers 820 is positioned in each waveguide arm 804 such that a central section 807 of waveguide arms 804 is open between each pair of transformers 820. The dielectric transformers 820 are dimensioned such that a proximal edge 821 of each transformer slightly overlaps the distal end of each ferrite segment 812, as depicted in FIGS. 8A, 8B, and 8D. This configuration allows for centering and rotationally aligning ferrite element 810 in waveguide housing 802.

The dielectric transformers 820 have a reduced height ($H_t$) that is less than the height ($H_w$) of waveguide housing 802 such that an upper surface 822 of transformers 820 is separated from waveguide ceiling 808 by an air gap 828. The height of dielectric transformers 820 can be from about 10% to about 80% of the height of waveguide housing 802, for example. The open central section 807 of waveguide arms 804 is located where the bowing displacement of a waveguide cover for the circulator would be at a maximum, thereby avoiding interference with the waveguide cover.

In addition, a control wire 832 such as a magnetizing winding can be threaded through a channel 834 in ferrite segments 812 to make ferrite element 810 switchable.

Example Embodiments

Example 1 includes a circulator comprising a waveguide housing having a plurality of hollow waveguide arms that communicate with a central cavity, the waveguide housing having a height defined by a plurality of waveguide sidewalls between a waveguide floor and a waveguide ceiling; a ferrite element disposed in the central cavity of the waveguide housing, the ferrite element including a central portion having an upper surface and a lower surface, the ferrite element further including a plurality of ferrite segments that each extend from the central portion and terminate at a distal end; and a plurality of dielectric transformers each having an upper surface, the dielectric transformers protruding into the waveguide arms away from the central cavity along the waveguide floor, the dielectric transformers having a height that is less than the height of the waveguide housing such that the upper surface of the transformers is separated from the waveguide ceiling by a gap; wherein the height of the dielectric transformers is about 5% to about 98% of the height of the waveguide housing.

Example 2 includes the circulator of Example 1, wherein the dielectric transformers are respectively attached to a central location at the distal end of each of the ferrite segments and protrude into each waveguide arm in alignment with the central portion of the ferrite element.

Example 3 includes the circulator of Example 1, wherein the dielectric transformers are respectively attached to each distal end of the ferrite segments in an off-center location, and protrude into each waveguide arm in an offset position from the central portion of the ferrite element.

Example 4 includes the circulator of Example 1, wherein the dielectric transformers are respectively attached to the distal end of each of the ferrite segments, the dielectric transformers each having a width that is greater than a width of each of the ferrite segments.

Example 5 includes the circulator of Example 1, wherein the dielectric transformers are respectively coupled to the distal end of each of the ferrite segments, the dielectric transformers each having a width that is greater than a width of each of the ferrite segments such that the width of the dielectric transformers is substantially the same as a width between opposing sidewalls of the waveguide arms.

Example 6 includes the circulator of Example 5, wherein the distal end of each of the ferrite segments is mounted in a recess located along a proximal edge of each of the dielectric transformers.

Example 7 includes the circulator of Example 1, wherein the dielectric transformers are respectively attached to the distal end of each of the ferrite segments, the dielectric transformers each having a width that is greater than a width of each of the ferrite segments, the upper surface of the dielectric transformers tapered inwardly toward a middle section such that the height of the dielectric transformers is shorter along the middle section.

Example 8 includes the circulator of Example 1, wherein the dielectric transformers are positioned along the waveguide sidewalls in each of the waveguide arms.

Example 9 includes the circulator of Example 1, wherein a pair of opposing transformers is positioned in each waveguide arm such that a central section of the waveguide arms is open between each opposing pair of transformers.

Example 10 includes the circulator of Example 9, wherein the dielectric transformers are dimensioned such that a proximal edge of each of the dielectric transformers overlaps with the distal end of each of the ferrite segments.

Example 11 includes the circulator of any of Examples 1-10, wherein the waveguide housing includes three waveguide arms.

Example 12 includes the circulator of Example 11, wherein the ferrite element has a Y-shaped structure that includes three ferrite segments that each respectively extend into one of the three waveguide arms.

Example 13 includes the circulator of any of Examples 1-12, wherein each ferrite segment includes a channel for threading a control wire through the ferrite element.

Example 14 includes the circulator of any of Examples 1-13, further comprising a magnetizing winding disposed in the ferrite element.

Example 15 includes the circulator of any of Examples 1-14, further comprising a first dielectric spacer located on the upper surface of the ferrite element, and a second dielectric spacer located on the lower surface of the ferrite element.

Example 16 includes the circulator of any of Examples 1-15, wherein the gap provides a clearance between the upper surface of the transformers and the waveguide ceiling of at least about 0.005 inches.

Example 17 includes a switching waveguide circulator comprising an electrically conductive waveguide housing having a plurality of hollow waveguide arms that communicate with a central cavity, the waveguide housing having a height defined by a plurality of waveguide sidewalls between a waveguide floor and a waveguide ceiling; a ferrite element disposed in the central cavity of the waveguide housing, the ferrite element including a central portion having an upper surface and a lower surface, the ferrite element further including a plurality of ferrite segments that each extend from the central portion and terminate at a distal end; a plurality of dielectric transformers each having an upper surface, the dielectric transformers protruding into the waveguide arms away from the central cavity along the waveguide floor, the dielectric transformers having a height that is less than the height of the waveguide housing such that the upper surface of the transformers is separated from the waveguide ceiling by a gap; a magnetizing control wire threaded through the ferrite segments; a first dielectric spacer located on the upper surface of the ferrite element; and a second dielectric spacer located on the lower surface of the ferrite element; wherein the gap provides a clearance between the upper surface of the transformers and the waveguide ceiling of at least about 0.005 inches.

Example 18 includes the switching waveguide circulator of Example 17, wherein the waveguide housing includes three waveguide arms, and the ferrite element includes three ferrite segments that each respectively extend into one of the three waveguide arms.

Example 19 includes a circulator comprising an electrically conductive waveguide housing having a plurality of hollow waveguide arms that communicate with a central cavity, the waveguide housing having a waveguide floor and a waveguide ceiling, the waveguide arms each having a width between opposing sidewalls coupled to the waveguide floor and the waveguide ceiling; a ferrite element disposed in the central cavity of the waveguide housing, the ferrite element including a central portion and a plurality of ferrite segments that each extend from the central portion and terminate at a distal end; and a plurality of dielectric transformers each respectively protruding into the waveguide arms away from the central cavity along the waveguide floor, the dielectric transformers each respectively coupled to the distal end of each of the ferrite segments, the dielectric transformers each having a width that is substantially the same as the width between the opposing sidewalls of the waveguide arms.

Example 20 includes the circulator of Example 19, wherein the distal end of each of the ferrite segments is mounted in a recess located along a proximal edge of each of dielectric transformers.

The present invention may be embodied in other forms without departing from its essential characteristics. The described embodiments are to be considered in all respects only as illustrative and not restrictive. Therefore, it is intended that this invention be limited only by the claims and the equivalents thereof.

What is claimed is:

1. A circulator, comprising:

a waveguide housing having a plurality of hollow waveguide arms that communicate with a central cavity, the waveguide housing having a height defined by a plurality of waveguide sidewalls between a waveguide floor and a waveguide ceiling;

a ferrite element disposed in the central cavity of the waveguide housing, the ferrite element including a central portion having an upper surface and a lower surface, the ferrite element further including a plurality of ferrite segments that each extend from the central portion and terminate at a distal end; and a plurality of dielectric transformers each having an upper surface and a lower surface, the dielectric transformers protruding into the waveguide arms away from the central cavity along the waveguide floor, with the lower surface of the dielectric transformers coupled to the waveguide floor, the dielectric transformers having a height that is less than the height of the waveguide housing such that the upper surface of the transformers is separated from the waveguide ceiling by a gap;

wherein a single transformer extends from each of the respective distal ends of the ferrite segments.

2. The circulator of claim 1, wherein the dielectric transformers are respectively attached to a central location at the distal end of each of the ferrite segments and protrude into each waveguide arm in alignment with the central portion of the ferrite element.

3. The circulator of claim 1, wherein the dielectric transformers are respectively attached to each distal end of the ferrite segments in an off-center location, and protrude into each waveguide arm in an offset position from the central portion of the ferrite element.

4. The circulator of claim 1, wherein the dielectric transformers are respectively attached to the distal end of each of the ferrite segments, the dielectric transformers each having a width that is greater than a width of each of the ferrite segments.

5. The circulator of claim 1, wherein the dielectric transformers are respectively attached to the distal end of each of the ferrite segments, the dielectric transformers each having a width that is greater than a width of each of the ferrite segments, the upper surface of the dielectric transformers tapered inwardly toward a middle section such that the height of the dielectric transformers is shorter along the middle section.

6. The circulator of claim 1, further comprising a magnetizing winding disposed in the ferrite element.

7. The circulator of claim 1, further comprising a first dielectric spacer located on the upper surface of the ferrite element, and a second dielectric spacer located on the lower surface of the ferrite element.

8. The circulator of claim 1, wherein the gap provides a clearance between the upper surface of the transformers and the waveguide ceiling of at least about 0.005 inches.

9. The circulator of claim 1, wherein the dielectric transformers are respectively coupled to the distal end of each of the ferrite segments, the dielectric transformers each having a width that is greater than a width of each of the ferrite segments such that the width of the dielectric transformers is substantially the same as a width between opposing sidewalls of the waveguide arms.

10. The circulator of claim 9, wherein the distal end of each of the ferrite segments is mounted in a recess located along a proximal edge of each of the dielectric transformers.

11. The circulator of claim 1, wherein the waveguide housing includes three waveguide arms.

12. The circulator of claim 11, wherein the ferrite element has a Y-shaped structure that includes three ferrite segments that each respectively extend into one of the three waveguide arms.

13. The circulator of claim 12, wherein each ferrite segment includes a channel for threading a control wire through the ferrite element.

14. A switching waveguide circulator, comprising:

an electrically conductive waveguide housing having a plurality of hollow waveguide arms that communicate with a central cavity, the waveguide housing having a height defined by a plurality of waveguide sidewalls between a waveguide floor and a waveguide ceiling;

a ferrite element disposed in the central cavity of the waveguide housing, the ferrite element including a central portion having an upper surface and a lower surface, the ferrite element further including a plurality of ferrite segments that each extend from the central portion and terminate at a distal end;

a plurality of dielectric transformers each having an upper surface and a lower surface, the dielectric transformers protruding into the waveguide arms away from the central cavity along the waveguide floor, with the lower surface of the dielectric transformers coupled to the waveguide floor, the dielectric transformers having a height that is less than the height of the waveguide housing such that the upper surface of the transformers is separated from the waveguide ceiling by a gap;

a magnetizing control wire threaded through the ferrite segments;

a first dielectric spacer located on the upper surface of the ferrite element; and a second dielectric spacer located on the lower surface of the ferrite element;

wherein the dielectric transformers protrude into the waveguide arms away from the distal ends of the ferrite segment without contacting the dielectric spacers.

15. The switching waveguide circulator of claim 14, wherein the waveguide housing includes three waveguide arms, and the ferrite element includes three ferrite segments that each respectively extend into one of the three waveguide arms.

16. The switching waveguide circulator of claim 14, wherein the dielectric transformers are positioned along the waveguide sidewalls in each of the waveguide arms.

17. The switching waveguide circulator of claim 14, wherein a pair of opposing transformers is positioned in each waveguide arm such that a central section of the waveguide arms is open between each opposing pair of transformers.

18. The switching waveguide circulator of claim 17, wherein the dielectric transformers are dimensioned such that a proximal edge of each of the dielectric transformers overlaps with the distal end of each of the ferrite segments.

* * * * *